US006092306A

United States Patent [19]

Newton-Dunn

[11] Patent Number: 6,092,306

[45] Date of Patent: Jul. 25, 2000

[54] TAP SHOE TAPS COVER SYSTEM

[76] Inventor: Tracey Newton-Dunn, 57 Middle Lane, Epsom, Surrey KT17 1DP, United Kingdom

[21] Appl. No.: 09/271,858

[22] Filed: Mar. 18, 1999

[51] Int. Cl.[7] ..... A43B 3/16; A43B 5/12

[52] U.S. Cl. ..... 36/7.1 R; 36/7.5; 36/8.3; 36/135

[58] Field of Search ..... 36/7.1 R, 7.5, 36/8.3, 135

[56] References Cited

U.S. PATENT DOCUMENTS

| | | | |
|---|---|---|---|
| 754,673 | 3/1904 | Mitchell | 36/135 |
| 1,063,205 | 6/1913 | Leonard | 36/7.5 |
| 2,128,134 | 8/1938 | Giusto | 36/7.5 |
| 2,723,467 | 11/1955 | Cassidy | 36/8.3 |
| 3,020,654 | 2/1962 | McCann | 36/135 |
| 4,258,483 | 3/1981 | Hogue | 36/135 |
| 4,364,187 | 12/1982 | Melendez | 36/7.5 |
| 5,007,185 | 4/1991 | Lazarski | 36/7.5 |

*Primary Examiner*—M. D. Patterson

[57] ABSTRACT

A tap shoe taps cover system for covering the taps of a tap shoe to permit a wearer of tap shoes to walk more quietly. The tap shoe taps cover system includes heel and ball tap covers each with upper and lower faces, and an outer perimeter. The tap cover each have a plurality of resiliently deflectable retaining clips upwardly extending from the upper face of the respective tap cover.

10 Claims, 2 Drawing Sheets

36
38
20
12
36
21
14
40
37
33
32
15
18
11
27

21
24
11
12
20
16
23
16
22
27
33
35
28
29
14
34
17
32
18
26
31
30
18

TAP SHOE TAPS COVER SYSTEM

BACKGROUND OF THE INVENTION

1. Field of the Invention

The present invention relates to tap shoe accessories and more particularly pertains to a new tap shoe taps cover system for covering the taps of a tap shoe to permit a wearer of tap shoes to walk more quietly.

2. Description of the Prior Art

The use of tap shoe accessories is known in the prior art. More specifically, tap shoe accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 754,673 by Mitchell; U.S. Pat. No. 3,574,959 by Cicero; U.S. Pat. No. 4,249,321 by Nagy; U.S. Pat. No. 4,825,563 by Strongwater; U.S. Pat. No. 5,367,794 by Adelstein et al.; and U.S. Pat. No. Des. 249,908 by Meinhart.

While these devices fulfill their respective, particular objectives and requirements, the aforementioned patents do not disclose a new tap shoe taps cover system. The inventive device includes heel and ball tap covers each with upper and lower faces, and an outer perimeter. The tap cover each have a plurality of resiliently deflectable retaining clips upwardly extending from the upper face of the respective tap cover.

In these respects, the tap shoe taps cover system according to the present invention substantially departs from the conventional concepts and designs of the prior art, and in so doing provides an apparatus primarily developed for the purpose of covering the taps of a tap shoe to permit a wearer of tap shoes to walk more quietly.

SUMMARY OF THE INVENTION

In view of the foregoing disadvantages inherent in the known types of tap shoe accessories now present in the prior art, the present invention provides a new tap shoe taps cover system construction wherein the same can be utilized for covering the taps of a tap shoe to permit a wearer of tap shoes to walk more quietly.

The general purpose of the present invention, which will be described subsequently in greater detail, is to provide a new tap shoe taps cover system apparatus and method which has many of the advantages of the tap shoe accessories mentioned heretofore and many novel features that result in a new tap shoe taps cover system which is not anticipated, rendered obvious, suggested, or even implied by any of the prior art tap shoe accessories, either alone or in any combination thereof.

To attain this, the present invention generally comprises heel and ball tap covers each with upper and lower faces, and an outer perimeter. The tap cover each have a plurality of resiliently deflectable retaining clips upwardly extending from the upper face of the respective tap cover.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tap shoe taps cover system apparatus and method which has many of the advantages of the tap shoe accessories mentioned heretofore and many novel features that result in a new tap shoe taps cover system which is not anticipated, rendered obvious, suggested, or even implied by any of the prior art tap shoe accessories, either alone or in any combination thereof.

It is another object of the present invention to provide a new tap shoe taps cover system which may be easily and efficiently manufactured and marketed.

It is a further object of the present invention to provide a new tap shoe taps cover system which is of a durable and reliable construction.

An even further object of the present invention is to provide a new tap shoe taps cover system which is susceptible of a low cost of manufacture with regard to both materials and labor, and which accordingly is then susceptible of low prices of sale to the consuming public, thereby making such tap shoe taps cover system economically available to the buying public.

Still yet another object of the present invention is to provide a new tap shoe taps cover system which provides in the apparatuses and methods of the prior art some of the advantages thereof, while simultaneously overcoming some of the disadvantages normally associated therewith.

Still another object of the present invention is to provide a new tap shoe taps cover system for covering the taps of a tap shoe to permit a wearer of tap shoes to walk more quietly.

Yet another object of the present invention is to provide a new tap shoe taps cover system which includes heel and ball tap covers each with upper and lower faces, and an outer perimeter. The tap cover each have a plurality of resiliently deflectable retaining clips upwardly extending from the upper face of the respective tap cover.

Still yet another object of the present invention is to provide a new tap shoe taps cover system that lets tap shoe performers walk quietly backstage during stage performances.

Even still another object of the present invention is to provide a new tap shoe taps cover system that protects the taps of tap shoes from damage when walking on surfaces that could damage the taps.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
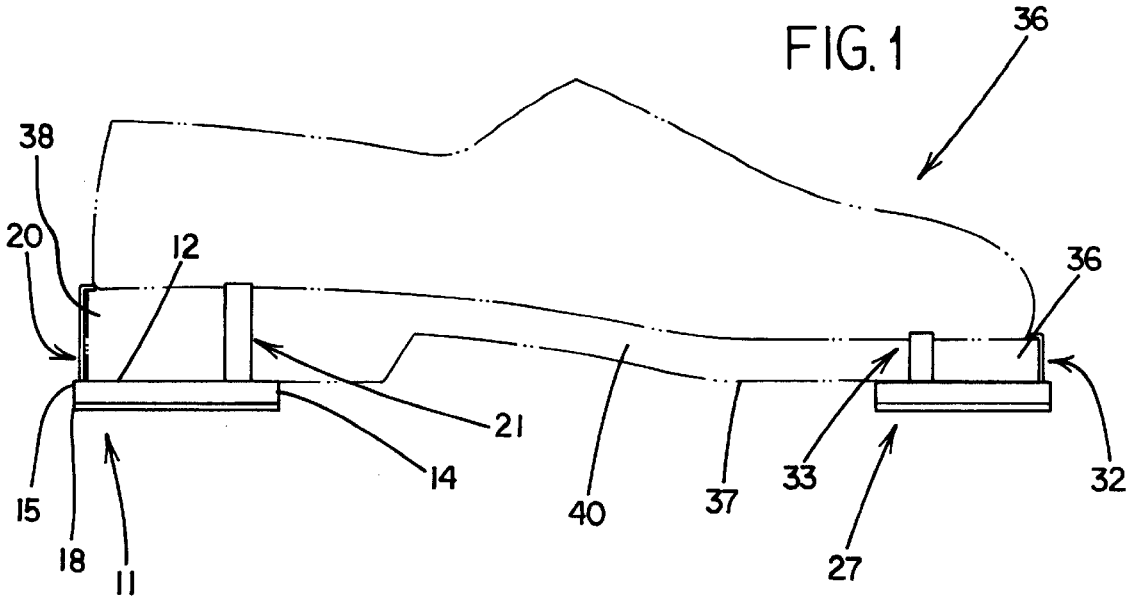
FIG. 1 is a schematic side view of a new tap shoe taps cover system in use according to the present invention.

With reference now to the drawings, and in particular to FIGS. 1 through 4 thereof, a new tap shoe taps cover system embodying the principles and concepts of the present invention will be described.

As best illustrated in FIGS. 1 through 4, the tap shoe taps cover system generally comprises heel and ball tap covers each with upper and lower faces, and an outer perimeter. The tap cover each have a plurality of resiliently deflectable retaining clips upwardly extending from the upper face of the respective tap cover.

In closer detail, tap shoe taps cover system comprises a generally trapezoidal heel tap cover 11 having generally trapezoidal and substantially flat upper and lower faces 12,13, and a generally trapezoidal outer perimeter. The outer perimeter of the heel tap cover comprises spaced apart and substantially parallel front and back edges 14,15, and a pair of substantially straight side edges 16,17 converging towards one another in a direction from the front edge of the heel tap cover to the back edge of the heel tap cover.

Figure 4:
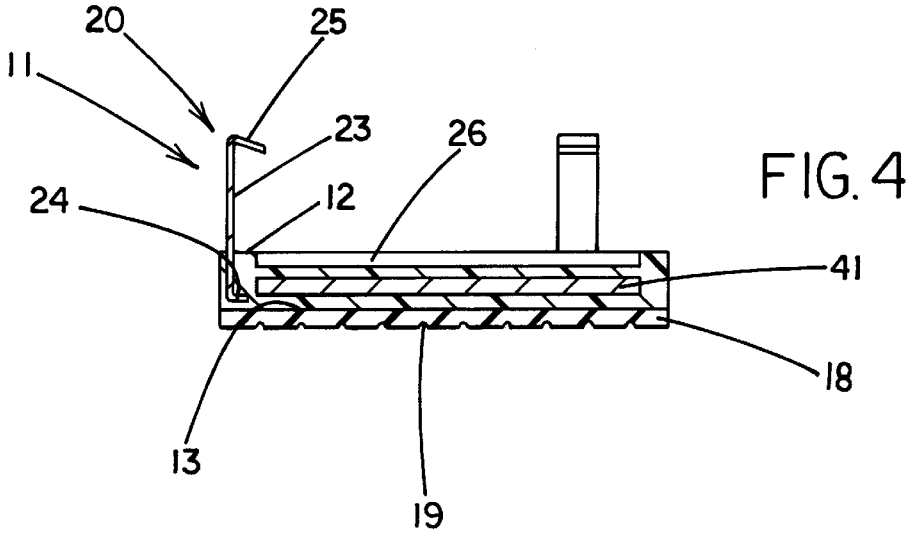
FIG. 4 is a schematic cross sectional view of a heel tap cover of the present invention taken from line 4—4 of FIG. 3 and illustrative of the cross section of both the heel tap cover and the ball tap cover.

Preferably, the lower face of the heel tap cover has a substantially coextensive sole layer 18 coupled thereto as illustrated in FIG. 4. The sole layer comprises a resiliently deformable material such as a resiliently deformable rubber or plastic for providing traction when engaging a ground surface to prevent a user from slipping on the ground surface. Even more preferably, the sole layer has a plurality of grooves 19 therein. Ideally, the grooves of the sole layer are arranged in a grid like fashion on the sole layer for optimally providing traction when engaging a ground surface.

The heel tap cover has a plurality of resiliently deflectable retaining clips 20,21,22 upwardly extending from the upper face of the heel tap cover. Each of the retaining clips has an elongate portion 23 extending substantially perpendicular to the upper face of the tap cover. The elongate portion of each retaining clip of the heel tap cover has opposite top and bottom ends. The bottom end of the elongate portion of the each retaining clip of the heel tap cover is extended into the heel tap cover while the top end of the elongate portion of the each retaining clip of the heel tap cover is outwardly extended from the upper face of the heel tap cover.

Each of the retaining clips has a lower flange 24 extending substantially perpendicularly from the bottom end of the elongate portion of the respective retaining clip. The lower flanges are designed for helping hold the retaining clips in the tap cover. Each of the retaining clips has an upper flange 25 at the top end of the elongate portion of the respective retaining clip of the heel tap cover. The upper flanges of the retaining clips are extended inwardly and downwardly towards a central region of the tap cover. The upper flanges of the retaining clips each is extended at an acute angle to the elongate portion of the respective retaining clip. Ideally, the acute angle is between about 75 degrees and about 80 degrees. Optimally, the upper flanges of the retaining clips each are deflectable in an upwards direction with respect to the associated elongate portion of the respective retaining clip to a position where the respective upper flange is extended no more than about 90 degrees from the associated elongate portion.

Figure 2:
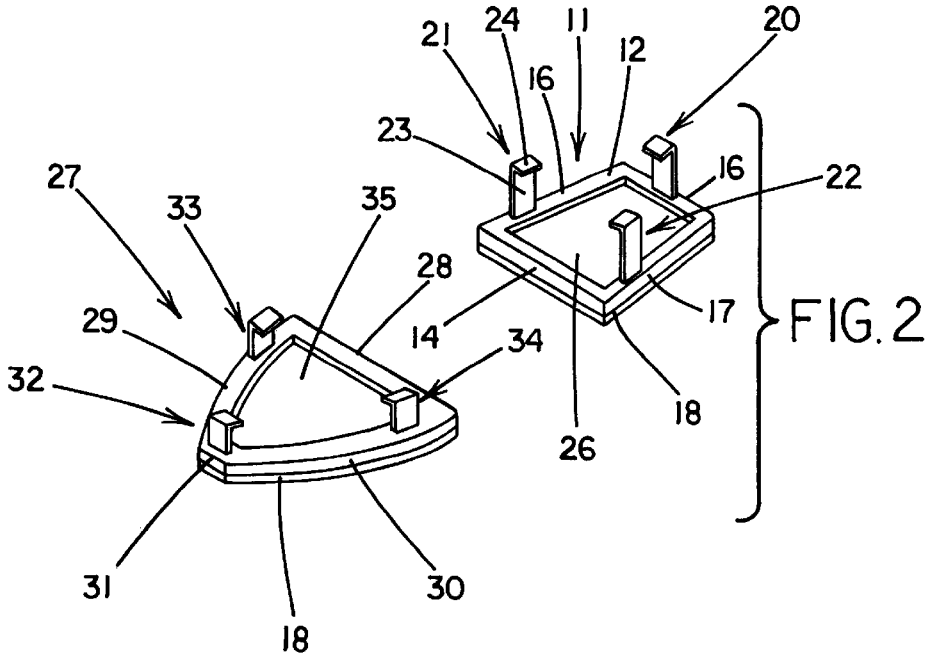
FIG. 2 is a schematic perspective view of the present invention.
Figure 3:
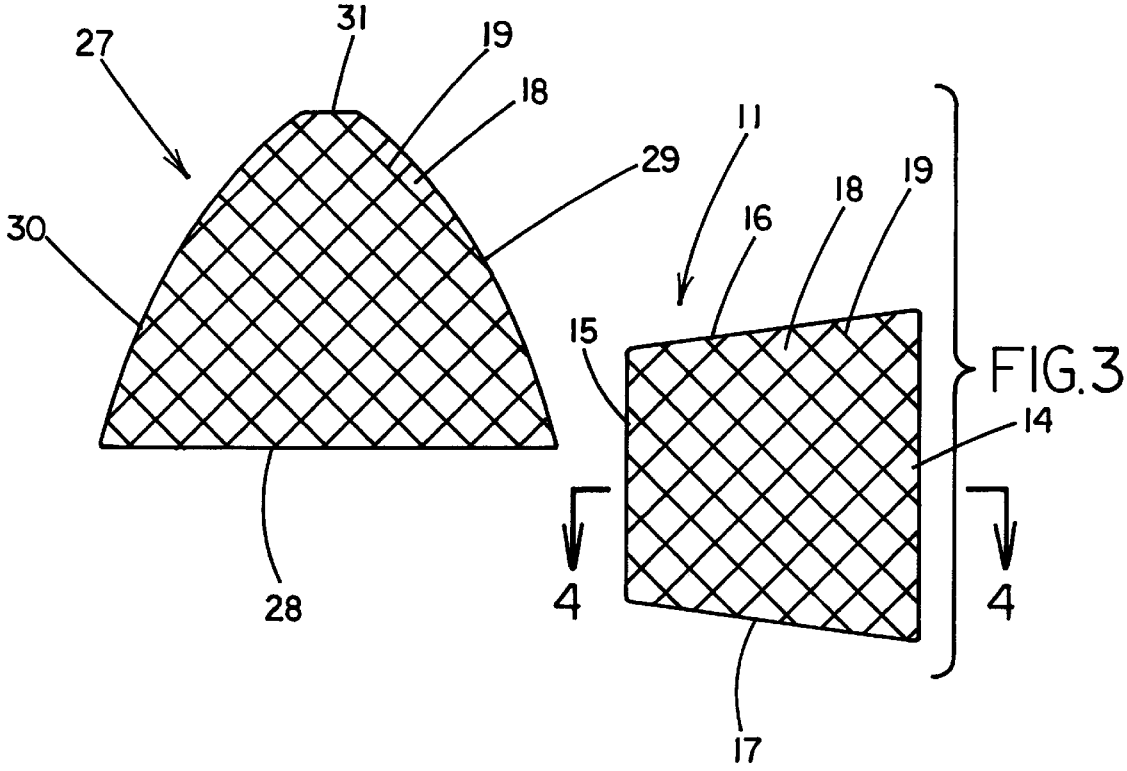
FIG. 3 is a schematic bottom view of the present invention.

With particular reference to FIG. 2, a first of the retaining clips of the heel tap cover is positioned adjacent the back edge of the heel tap cover, a second of the retaining clips of the heel tap cover is positioned adjacent one of the side edges of the heel tap cover, and a third of the retaining clips of the heel tap cover is positioned adjacent the other of the side edges of the heel tap cover.

The heel tap cover has a generally trapezoidal tap depression 26 in the upper face of the heel tap cover with the retaining clips of the heel tap cover positioned around the tap depression of the heel tap cover. Preferably, the heel tap cover has a magnet 41 enclosed therein and located between the upper and lower faces of the heel tap cover.

The ball tap cover 27 is the same as the heel tap cover with the following exceptions. The ball tap cover has generally triangular and substantially flat upper and lower faces, and a generally triangular outer perimeter comprising a substantially straight back edge 28 and a pair of side edges 29,30 extending from the back edge of the ball tap cover and converging together at a front vertex 31. Preferably, the side edges of the ball tap cover are slightly curved in shape with outwardly facing convexities. A first of the retaining clips 32 of the ball tap cover is positioned adjacent the front vertex of the ball tap cover. A second of the retaining clips 33 of the ball tap cover is positioned adjacent one of the side edges of the ball tap cover. A third of the retaining clips 34 of the ball tap cover is positioned adjacent the other of the side edges of the ball tap cover. The ball tap cover also has a generally triangular tap depression 35 in the upper face of the ball tap cover corresponding to the overall shape of the ball tap cover.

As illustrated in FIG. 1, the tap covers are designed for use with a tap shoe 36 has a sole 37 for engaging a ground surface. The sole of the tap shoe has opposite heel and toe ends 38,39, and a perimeter side 40. The tap shoe has a heel tap coupled to the sole adjacent the heel end of the sole and a ball tap coupled to the sole adjacent the toe end of the sole. In use, the upper face of the heel tap cover is positioned adjacent the sole of the tap shoe beneath the heel tap of the tap shoe. The back end of the heel tap cover is positioned adjacent the heel end of the sole of the tap shoe. The upper flanges of the retaining clips of the heel tap cover are hooked over the perimeter side of the sole of the tap shoe to help hold the heel tap cover to the sole of the tap shoe beneath the heel tap of the tap shoe. The tap depression of the heel tap cover receives the heel tap of the tap shoe therein. The magnet of the heel tap cover is magnetically attracted to the heel tap of the tap shoe to help magnetically hold the heel tap cover to the heel tap of the tap shoe. Similarly, the upper face of the ball tap cover is positioned adjacent the sole of the tap shoe beneath the ball tap of the tap shoe with the front vertex of the ball tap cover positioned adjacent the toe end of the sole of the tap shoe. The upper flanges of the retaining clips of the ball tap cover are hooked over the perimeter side of the sole of the tap shoe to help hold the ball tap cover to the sole of the tap shoe beneath the ball tap of the tap shoe. The tap depression of the ball tap cover receives the ball tap of the tap shoe therein with the magnet of the ball tap cover magnetically attracted to the ball tap of the tap shoe to help magnetically hold the ball tap cover to the heel tap of the tap shoe.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tap shoe taps cover system, comprising:

a tap shoe having a sole, said sole of said tap shoe having opposite heel and toe ends, and a perimeter side;

said tap shoe having a heel tap coupled to said sole adjacent said heel end of said sole, and a ball tap coupled to said sole adjacent said toe end of said sole;

a heel tap cover for covering said heel tap of said tap shoe, said heel tap cover having upper and lower faces, and an outer perimeter;

said heel tap cover having a plurality of resiliently deflectable retaining clips upwardly extending from said upper face of said heel tap cover;

a ball tap cover for covering said ball tap of said tap shoe, said ball tap cover having upper and lower faces, and an outer perimeter; and said ball tap cover having a plurality of resiliently deflectable retaining clips upwardly extending from said upper face of said ball tap cover.

2. A tap shoe taps cover system, comprising:

a heel tap cover having upper and lower faces, and an outer perimeter;

said heel tap cover having a plurality of resiliently deflectable retaining clips upwardly extending from said upper face of said heel tap cover;

a first of said retaining clips of said heel tap cover being positioned adjacent a back edge of said heel tap cover, a second of said retaining clips of said heel tap cover being positioned adjacent one of a pair of side edges of said heel tap cover, a third of said retaining clips of said heel tap cover being positioned adjacent the other of said side edges of said heel tap cover;

a ball tap cover having upper and lower faces, and an outer perimeter;

said ball tap cover having a plurality of resiliently deflectable retaining clips upwardly extending from said upper face of said ball tap cover; and a first of said retaining clips of said ball tap cover being positioned adjacent a front vertex of said ball tap cover, a second of said retaining clips of said ball tap cover being positioned adjacent one of a pair of side edges of said ball tap cover, a third of said retaining clips of said ball tap cover being positioned adjacent the other of said side edges of said ball tap cover.

3. The tap shoe taps cover system of claim 2, wherein said lower faces of said heel tap cover and ball tap cover each have a substantially coextensive sole layer, said sole layers each comprising a resiliently deformable material.

4. The tap shoe taps cover system of claim 3, wherein said sole layers each have a plurality of grooves therein, said grooves of each sole layer being arranged in a grid on the respective sole layer.

5. The tap shoe taps cover system of claim 2, wherein each of said retaining clips has an elongate portion upwardly extending from said upper face of the associated tap cover, said elongate portion of each retaining clip having opposite top and bottom ends, said bottom end of said elongate portion of said each retaining clip of said heel tap cover being extended into the associated tap cover.

6. The tap shoe taps cover system of claim 5, wherein each of said retaining clips has a lower flange extending substantially perpendicularly from said bottom end of the elongate portion of the respective retaining clip.

7. The tap shoe taps cover system of claim 5, wherein each of said retaining clips has an upper flange at said top end of said elongate portion of the respective retaining clip, said upper flanges of said retaining clips each being extended at an acute angle to said elongate portion of the respective retaining clip, wherein said upper flanges of said retaining clips each are deflectable in an upwards direction with respect to the associated elongate portion of the respective retaining clip to a position where the respective upper flange is extended no more than about 90 degrees from the associated elongate portion.

8. The tap shoe taps cover system of claim 2, wherein said tap covers each have a tap depression in said upper face of respective tap cover, said retaining clips of said respective tap cover being positioned around said tap depression of said respective tap cover.

9. The tap shoe taps cover system of claim 2, wherein each of said tap covers has a magnet enclosed therein.

10. A tap shoe taps cover system, comprising:

a tap shoe having a sole, said sole of said tap shoe having opposite heel and toe ends, and a perimeter side;

said tap shoe having a heel tap coupled to said sole adjacent said heel end of said sole, and a ball tap coupled to said sole adjacent said toe end of said sole;

a generally trapezoidal heel tap cover having generally trapezoidal and substantially flat upper and lower faces, and a generally trapezoidal outer perimeter;

said outer perimeter of said heel tap cover comprising spaced apart and substantially parallel front and back edges, and a pair of substantially straight side edges converging towards one another in a direction from said front edge of said heel tap cover to said back edge of said heel tap cover;

said lower face of said heel tap cover having a substantially coextensive sole layer;

said sole layer comprising a resiliently deformable material;

said sole layer of said heel tap cover having a plurality of grooves therein, said grooves of said sole layer of said heel tap cover being arranged in a grid on said sole layer of said heel tap cover;

said heel tap cover having a plurality of resiliently deflectable retaining clips upwardly extending from said upper face of said heel tap cover;

each of said retaining clips of said heel tap cover having an elongate portion extending substantially perpendicular to said upper face of said heel tap cover;

said elongate portion of each retaining clip of said heel tap cover having opposite top and bottom ends, said bottom end of said elongate portion of said each retaining clip of said heel tap cover being extended into said heel tap cover, said top end of said elongate portion of said each retaining clip of said heel tap cover being outwardly extended from said upper face of said heel tap cover;

each of said retaining clips of said heel tap cover having a lower flange extending substantially perpendicularly from said bottom end of said elongate portion of the respective retaining clip of said heel tap cover;

each of said retaining clips of said heel tap cover having an upper flange at said top end of said elongate portion of the respective retaining clip of said heel tap cover;

said upper flanges of said retaining clips of said heel tap cover being extended inwardly and downwardly towards a central region of said heel tap cover;

said upper flanges of said retaining clips of said heel tap cover each being extended at an acute angle to said elongate portion of the respective retaining clip of said heel tap cover, wherein said acute angle is between about 75 degrees and about 80 degrees;

said upper flanges of said retaining clips of said heel tap cover each being deflectable in an upwards direction with respect to the associated elongate portion of the respective retaining clip of said heel tap cover to a position where the respective upper flange is extended no more than about 90 degrees from the associated elongate portion;

a first of said retaining clips of said heel tap cover being positioned adjacent said back edge of said heel tap cover, a second of said retaining clips of said heel tap cover being positioned adjacent one of said side edges of said heel tap cover, a third of said retaining clips of said heel tap cover being positioned adjacent the other of said side edges of said heel tap cover;

said heel tap cover having a generally trapezoidal tap depression in said upper face of said heel tap cover, said retaining clips of said heel tap cover being positioned around said tap depression of said heel tap cover;

said heel tap cover having a magnet enclosed therein and located between said upper and lower faces of said heel tap cover;

said upper face of said heel tap cover being positioned adjacent said sole of said tap shoe beneath said heel tap of said tap shoe;

said back end of said heel tap cover being positioned adjacent said heel end of said sole of said tap shoe;

said upper flanges of said retaining clips of said heel tap cover being hooked over said perimeter side of said sole of said tap shoe to help hold said heel tap cover to said sole of said tap shoe beneath said heel tap of said tap shoe;

said tap depression of said heel tap cover receiving said heel tap of said tap shoe therein;

said magnet of said heel tap cover being magnetically attracted to said heel tap of said tap shoe to help magnetically hold said heel tap cover to said heel tap of said tap shoe;

a generally triangular ball tap cover having generally triangular and substantially flat upper and lower faces, and a generally triangular outer perimeter;

said outer perimeter of said ball tap cover comprising a substantially straight back edge and a pair of arcuate side edges extending from said back edge of said ball tap cover and converging together at a front vertex;

said side edges of said ball tap cover each having outwardly facing convexities;

said lower face of said ball tap cover having a substantially coextensive sole layer;

said sole layer comprising a resiliently deformable material;

said sole layer of said ball tap cover having a plurality of grooves therein, said grooves of said sole layer of said ball tap cover being arranged in a grid on said sole layer of said heel tap cover;

said ball tap cover having a plurality of resiliently deflectable retaining clips upwardly extending from said upper face of said ball tap cover;

each of said retaining clips of said ball tap cover having an elongate portion extending substantially perpendicular to said upper face of said ball tap cover;

said elongate portion of each retaining clip of said ball tap cover having opposite top and bottom ends, said bottom end of said elongate portion of said each retaining clip of said ball tap cover being extended into said ball tap cover, said top end of said elongate portion of said each retaining clip of said ball tap cover being outwardly extended from said upper face of said ball tap cover;

each of said retaining clips of said ball tap cover having a lower flange extending substantially perpendicularly from said bottom end of said elongate portion of the respective retaining clip of said ball tap cover;

each of said retaining clips of said ball tap cover having an upper flange at said top end of said elongate portion of the respective retaining clip of said ball tap cover; said upper flanges of said retaining clips of said ball tap cover being extended inwardly and downwardly towards a central region of said ball tap cover;

said upper flanges of said retaining clips of said ball tap cover each being extended at an acute angle to said elongate portion of the respective retaining clip of said ball tap cover, wherein said acute angle is between about 75 degrees and about 80 degrees;

said upper flanges of said retaining clips of said ball tap cover each being deflectable in an upwards direction with respect to the associated elongate portion of the respective retaining clip of said ball tap cover to a position where the respective upper flange is extended no more than about 90 degrees from the associated elongate portion;

a first of said retaining clips of said ball tap cover being positioned adjacent said front vertex of said ball tap cover, a second of said retaining clips of said ball tap cover being positioned adjacent one of said side edges of said ball tap cover, a third of said retaining clips of said ball tap cover being positioned adjacent the other of said side edges of said ball tap cover;

said ball tap cover having a generally triangular tap depression in said upper face of said ball tap cover, said retaining clips of said ball tap cover being positioned around said tap depression of said ball tap cover;

said ball tap cover having a magnet enclosed therein and located between said upper and lower faces of said ball tap cover;

said upper face of said ball tap cover being positioned adjacent said sole of said tap shoe beneath said ball tap of said tap shoe;

said front vertex of said ball tap cover being positioned adjacent said toe end of said sole of said tap shoe;

said upper flanges of said retaining clips of said ball tap cover being hooked over said perimeter side of said sole of said tap shoe to help hold said ball tap cover to said sole of said tap shoe beneath said ball tap of said tap shoe;

said tap depression of said ball tap cover receiving said ball tap of said tap shoe therein; and said magnet of said ball tap cover being magnetically attracted to said ball tap of said tap shoe to help magnetically hold said ball tap cover to said heel tap of said tap shoe.

* * * * *